United States Patent [19]

Brockmanns et al.

[11] Patent Number: 4,815,267

[45] Date of Patent: Mar. 28, 1989

[54] FRICTION SPINNING APPARATUS

[76] Inventors: Karl-Josef Brockmanns, Jakob-Krebs-Strasse 80, D-4156 Willich 2; Joachim Lünenschloss, Schloss-Schönau-Strasse 81, D-5100 Aachen, both of Fed. Rep. of Germany

[21] Appl. No.: 91,543

[22] Filed: Aug. 31, 1987

[30] Foreign Application Priority Data

Aug. 29, 1986 [DE] Fed. Rep. of Germany ..... 3629433

[51] Int. Cl.[4] ..... D01H 7/892; D01H 7/898

[52] U.S. Cl. ..... 57/401; 57/411; 57/413

[58] Field of Search ..... 57/400, 401, 411, 413

[56] References Cited

U.S. PATENT DOCUMENTS

| | | | |
|---|---|---|---|
| 4,483,136 | 11/1984 | Stahlecker et al. | 57/401 |
| 4,567,722 | 2/1986 | Stahlecker | 57/401 |
| 4,574,581 | 3/1986 | Stahlecker | 57/401 |
| 4,640,090 | 2/1987 | Lembeck | 57/401 |

FOREIGN PATENT DOCUMENTS

| | | |
|---|---|---|
| 2943063 | 5/1980 | Fed. Rep. of Germany . |
| 3120877 | 12/1982 | Fed. Rep. of Germany . |
| 3318924 | 11/1984 | Fed. Rep. of Germany . |
| 3342472 | 6/1985 | Fed. Rep. of Germany . |
| 3502427 | 7/1986 | Fed. Rep. of Germany . |

*Primary Examiner*—John Petrakes

*Attorney, Agent, or Firm*—Herbert L. Lerner; Laurence A. Greenberg

[57] ABSTRACT

A friction spinning apparatus includes two drums being driven in the same direction and defining a wedge-shaped gap therebetween with a spinning region. A suction device is disposed in at least one of the drums and directed against the wedge-shaped gap. A yarn draw-off apparatus draws off yarn produced in the wedge-shaped gap. A fiber supply device is provided with a fiber guide channel. The fiber guide channel has one side with a slit-like fiber dispersion opening formed therein and disposed in the wedge-shaped gap and another side facing away from the fiber dispersion opening. A variable ventilation opening is formed in the other side of the fiber guide channel for varying fiber mass distribution in the spinning region.

12 Claims, 2 Drawing Sheets

FIG. 1
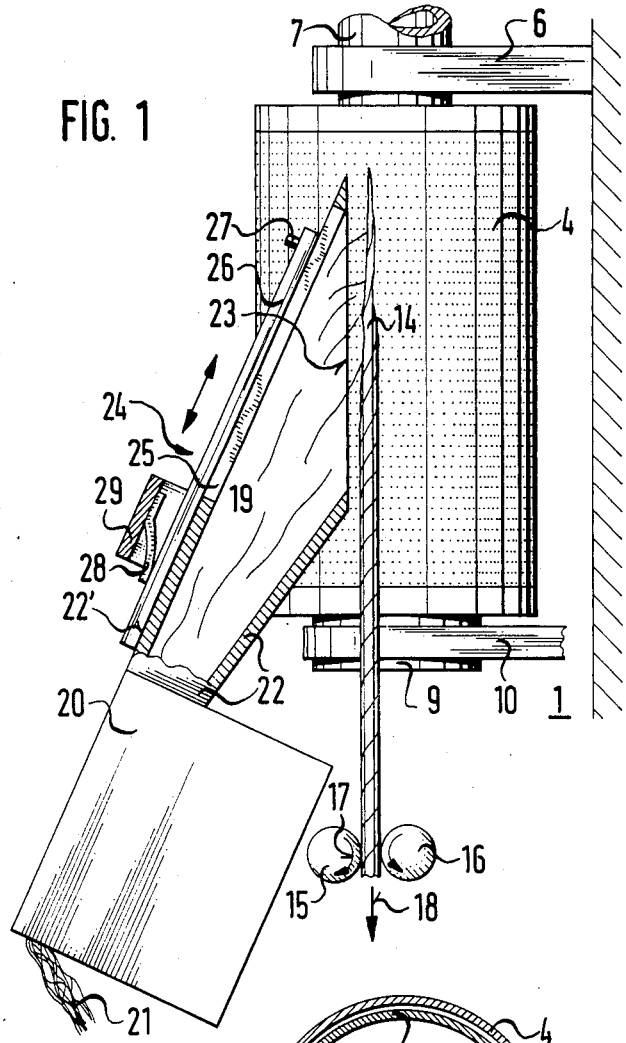
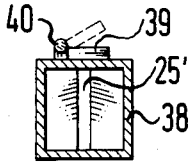
FIG. 5
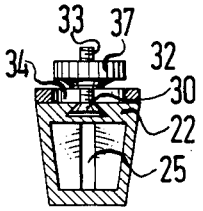
FIG. 4
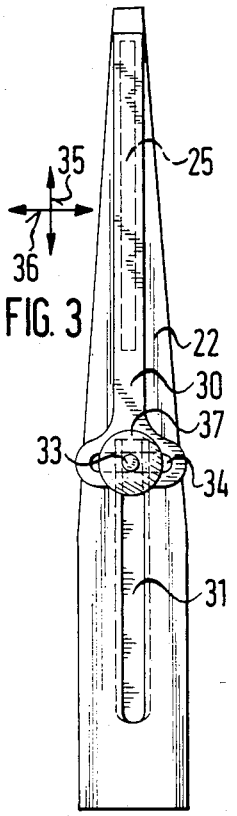
FIG. 3
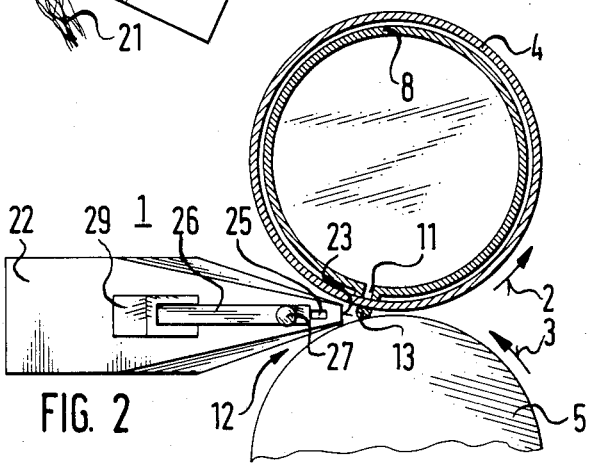
FIG. 2

FRICTION SPINNING APPARATUS

The invention relates to a friction spinning apparatus having two drums which are driven in the same direction forming a wedge-shaped gap with a spinning region, at least one of the drums having a suction device in the interior thereof directed against the wedge-shaped gap, a fiber supply device having a fiber guide channel with a slit-like fiber dispersion opening disposed in the wedge-shaped gap, and a yarn draw-off apparatus.

One problem in friction spinning is that opportunities for distributing the fiber mass in the spinning region are either nonexistent or quite limited. The spinning product is correspondingly unsatisfactory.

It is accordingly an object of the invention to provide a friction spinning apparatus, which overcomes the hereinafore-mentioned disadvantages of the heretofore-known devices of this general type and to improve the spinning product by exerting influence on the distribution of the fiber mass in the spinning region.

With the foregoing and other objects in view there is provided, in accordance with the invention, a friction spinning apparatus, comprising two drums being driven or drivable in the same direction and defining a wedge-shaped gap therebetween with a spinning region, a suction device being disposed in at least one of the drums and directed against the wedge-shaped gap, a yarn draw-off apparatus for drawing off yarn produced in the wedge-shaped gap, a fiber supply device having a fiber guide channel, the fiber guide channel having one side with a slit-like fiber dispersion opening formed therein and disposed in the wedge-shaped gap and the fiber guide channel having another side facing away from the fiber dispersion opening, and means disposed at the other side of the fiber guide channel for varying fiber mass distribution in the spinning region, the varying means including a variable ventilation opening formed in the fiber guide channel.

Depending on the magnitude of the negative pressure in the wedge-shaped gap, ambient air is introduced through the variable ventilation opening into the fiber guide channel. However, air can also be supplied from some external source.

In accordance with another feature of the invention, the ventilation opening is in the form of a slit-like opening oriented in the longitudinal direction of the fiber guide channel, and including a positionally variable cover for varying an open cross section of the ventilation opening.

In accordance with a further feature of the invention, the cover is in the form of a slide displaceable in at least one of the longitudinal and the transverse directions of the opening.

In accordance with an added feature of the invention, the cover is in the form of a cap being movable to a selectable distance from the opening.

In accordance with an additional feature of the invention, the cover is in the form of a flap.

In accordance with yet another feature of the invention, the flap is pivotably supported on one longitudinal side of the opening.

Since the apparatus according to the invention varies the fiber mass distribution in the spinning region, this has an effect on the uniformity of the yarn and on the twist that is attainable.

For an automatic spinning operation, in accordance with yet a further feature of the invention, there are provided means for automatically controlling the cover for varying spinning parameters. The control can be continuous in order to assure a uniform spinning product, or it can be carried out abruptly at batch changing times.

Another advantage for an automatic spinning operation is that in accordance with yet an added feature of the invention, there is provided a a cleaning device for the wedge-shaped gap having a suction nozzle, and means for bringing the suction nozzle flush to the wedge-shaped gap, the suction nozzle being attached to the fiber guide channel at the ventilation opening, or being introduced into the ventilation opening, at least during a cleaning process. Through the use of this feature of the invention, it is possible to clean the gap without having to pivot the fiber guide channel out of the way.

In accordance with yet an additional feature of the invention, the cover is in the form of a slide adjustable in longitudinal direction of the ventilation opening, in transverse direction of the ventilation opening and at angles to the directions.

In accordance with a concomitant feature of the invention, there is provided a dovetail guide disposed on the fiber guide channel, a set screw inserted in the dovetail guide, the slide having a transverse slit formed therein for displaceably supporting the set screw in the dovetail guide, and a nut disposed on the set screw for securing a position assumed by the slide.

Other features which are considered as characteristic for the invention are set forth in the appended claims.

Although the invention is illustrated and described herein as embodied in a friction spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a fragmentary, diagrammatic, partly cross-sectional and partly broken-away view of a first embodiment of the invention;

FIG. 2 is another fragmentary, partly cross-sectional view of the apparatus of FIG. 1;

FIGS. 3–5 are various views of different embodiments of the cover for the ventilation opening of the fiber guide channel;

Figure 6:
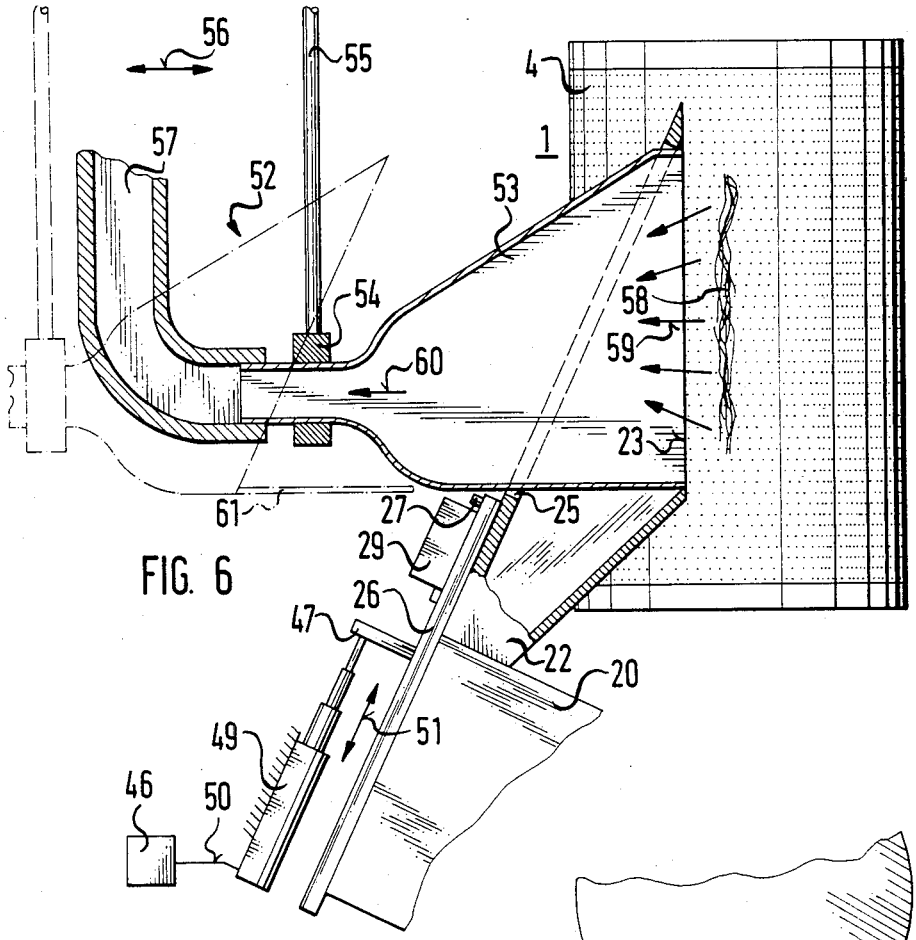
FIG. 6 is a view similar to FIG. 1 of another embodiment of the invention.

Referring now to the figures of the drawings in detail and first, particularly, to the first embodiment of the invention shown in FIGS. 1 and 2 thereof, there is seen a friction spinning apparatus generally designated by reference numeral 1, in which only those parts necessary for an understanding the invention are shown. The apparatus 1 has two drums 4, 5 which are drivable in the same direction, as indicated by arrows 2, 3. The drums are perforated, as shown particularly in FIG. 1. A support 6 that is structurally attached to a frame, supports a suction tube 7 of a suction device or apparatus 8. The suction tube 7 and the suction apparatus 8 are accordingly also structurally attached to the frame. The suction tube 7 and the suction apparatus 8 have non-illustrated roller bearings which support the drum 4 at the beginning and at the end of the drum. One end of the drum 4 is provided with a pulley 9, through which the drum 4 can be driven by a drive belt 10.

FIG. 2 shows that the suction apparatus 8 is formed of a cylinder that has a slit-like opening 11. The opening 11 is oriented toward a wedge-shaped gap or spinning wedge 12 that is formed by the two drums 4, 5. As shown in FIG. 2, the wedge-shaped gap 12 has a spinning region 13. FIG. 1 shows how yarn or thread 14 forms in the spinning region and is continuously drawn out of the wedge-shaped gap 12 parallel to the axes of rotation of the drums 4, 5 by a yarn draw-off apparatus 15, 16. The yarn draw-off apparatus includes one roller 15 driven in the direction of an arrow 17 and one contact roller 16, which can be placed in contact with the driven roller 15 or with the yarn 14 and has no drive mechanism of its own. The draw-off of yarn or thread is effected in the direction of an arrow 18.

The drum 5 has basically the same structure as the drum 4. However, the drum 5 may also be unperforated, depending on the circumstances, or it may be in the form of a rubber blanket or the like wrapped around a roller.

The yarn 14 is produced from spinning fibers 19, which are produced from sliver 21 in the conventional manner in a fiber supply device 20. The fiber supply device 20 is provided with a fiber guide channel 22, having a slit-like fiber dispersion opening 23 which is located in the wedge-shaped gap 12. A side 22' of the fiber guide channel 22 remote from the fiber dispersion opening 23, has a configuration, generally identified by reference numeral 24, for varying the fiber mass distribution in the spinning region 13. The configuration or means 24 for varying the fiber mass distribution takes the form of a variable ventilation opening 25 in the illustrated embodiment. The ventilation opening 25 is a slit-like opening disposed in the longitudinal direction of the fiber guide channel 22. The open cross section of the opening 25 is variable by means of a positionally variable cover 26, in the form of a slide that is displaceable in the longitudinal direction of the opening 25. The slide 26 can be moved forward and backward by means of an actuation pin 27. The slide 26 is loaded by a leaf spring 28, which also serves to lock it in a particular slide position. The leaf spring 28 is structurally connected to a housing in a casing 29 that is connected to the fiber guide channel 22.

In the alternative embodiment of FIGS. 3 and 4, a slide 30 that covers the ventilation opening 25 is displaceable both in the longitudinal and in the transverse directions of the opening 25. To this end, the fiber guide channel 22 has a dovetail guide 31 on the top thereof for guiding a conical base 32 of a set screw 33, threaded into a transverse slit 34 provided in the slide 30. When the set screw 33 is displaced in the dovetail guide 31, the slide 30 is carried along with it. This uncovers a variably long portion of the ventilation opening 25. However, the slide 30 can also be displaced transversely or at a predetermined angle relative to the ventilation opening 25. The preferential directions of displaceability are indicated by arrows 35, 36 in FIG. 3. Once the correct position for the slide 30 has been found, the slide is locked in this position by tightening a knurled nut 37.

FIG. 5 shows another embodiment of the cover. A fiber guide channel 38, which is diagrammatically illustrated, has a slit-like ventilation opening 25', which is variable by means of an adjustable flap 39. The flap 39 is pivotably connected to one long side of the opening, which is indicated in the drawing by means of a hinge 40.

Figure 8:
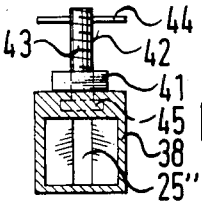
FIG. 8 is a view similar to FIG. 5 of another embodiment of a cover for the ventilation opening of the fiber guide channel.

In the FIG. 8 embodiment, the diagrammatically illustrated fiber guide channel 38 has a cover in the form of a cap 41 that can be disposed at a selectable distance from the valve opening 25''. The cap 41 has a spindle thread 42 on each of two ends thereof. A spindle 43 is screwed into each spindle thread and each spindle 43 is provided with a crossbar 44. Each of the spindles 43 has a disk-like base 45, which is rotatably supported in a suitable opening in the fiber guide channel 38.

Depending on the position of the spindles 43, the cap 41 can either close the ventilation opening of the fiber guide channel 38 completely, as shown in FIG. 8, or it can open it to a variable extent.

Figure 7:
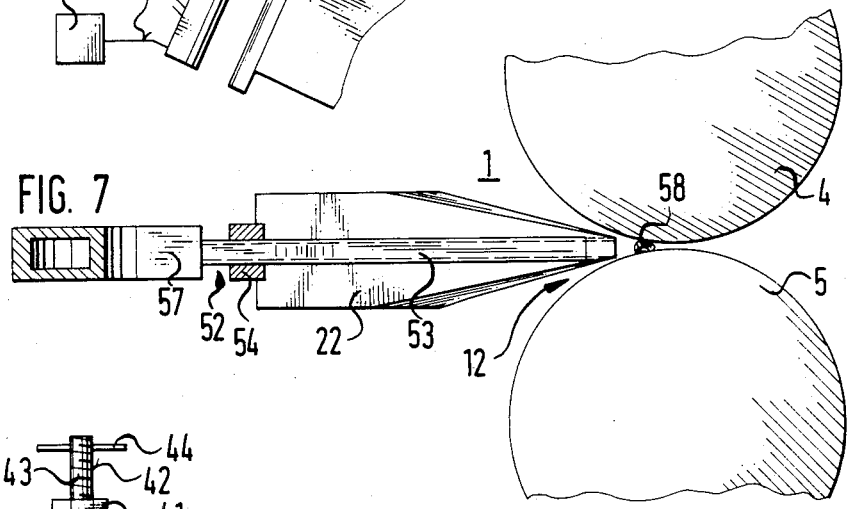
FIG. 7 is a view similar to FIG. 2 of the apparatus of FIG. 6.

Another embodiment of the invention is shown in FIGS. 6 and 7.

Much of the structure of the friction spinning apparatus 1 in FIGS. 6 and 7 is the same as in the friction spinning apparatus shown in FIGS. 1 and 2. Accordingly, it is unnecessary to give a complete description of the friction spinning apparatus at this point.

However, the embodiment illustrated in FIGS. 6 and 7 is distinguished by the feature that the cover 26 is controllable by means of an automatic apparatus 46 that varies spinning parameters. To this end, a telescoping tube configuration of a pneumatic control motor 49 is attached to the housing and has an operative connection 50 leading to the automatic apparatus 46. The pneumatic control motor 49 is capable of precisely displacing the slide 26 in the direction of a double arrow 51 under the control of the automatic apparatus 46. This is done in accordance with the desired parameters that are definitive for the spinning operation.

The embodiment of FIGS. 6 and 7 also provides a gap cleaning device 52 having a suction nozzle 53 which can be brought to the wedge-shaped gap 12 after retraction of the slide 26.

A sleeve 54 connects the suction nozzle 53 with a holder 55 which is displaceable in the direction of a double arrow 56. The suction nozzle 53 discharges into a suction tube 57.

The figures show that after the introduction of the suction nozzle 53 into the wedge-shaped gap 12, any deposits of dirt 58 that may be present there are aspirated as indicated by arrows 59 and can be removed by suction in the direction of an arrow 60.

Instead of having the shape shown in solid lines in FIG. 6, the suction nozzle 53 can also have the shape shown in phantom. In that case it would penetrate the ventilation opening 25 to a depth of only a few millimeters, and it would have a skirt 61 that is capable of blocking off the fiber guide channel 22.

We claim:

1. Friction spinning apparatus, comprising two drums being driven in the same direction and defining a wedge-shaped gap therebetween with a spinning region, a suction device being disposed in at least one of said drums and directed against said wedge-shaped gap, a yarn draw-off apparatus for drawing off yarn produced in said wedge-shaped gap, a fiber supply device having a fiber guide channel, said fiber guide channel having one side with a slit-like fiber dispersion opening formed therein and disposed in said wedge-shaped gap and said fiber guide channel having another side facing away from said fiber dispersion opening, and means disposed at said other side of said fiber guide channel for varying fiber mass distribution in said spinning region, said varying means including a variable ventilation opening formed in said fiber guide channel.

2. Friction spinning apparatus according to claim 1, wherein said ventilation opening is in the form of a slit-like opening oriented in the longitudinal direction of said fiber guide channel, and including a positionally variable cover for varying an open cross section of said ventilation opening.

3. Friction spinning apparatus according to claim 2, wherein said cover is in the form of a slide displaceable in at least one of the longitudinal and the transverse directions of said opening.

4. Friction spinning apparatus according to claim 2, wherein said cover is in the form of a cap being movable to a selectable distance from said opening.

5. Friction spinning apparatus according to claim 2, wherein said cover is in the form of a flap.

6. Friction spinning apparatus according to claim 5, wherein said flap is pivotably supported on one longitudinal side of said opening.

7. Friction spinning apparatus according to claim 2, including means for automatically controlling said cover for varying spinning parameters.

8. Friction spinning apparatus according to claim 2, wherein said cover is in the form of a slide adjustable in longitudinal direction of said ventilation opening, in transverse direction of said ventilation opening and at angles to said directions.

9. Friction spinning apparatus according to claim 8, including a dovetail guide disposed on said fiber guide channel, a set screw inserted in said dovetail guide, said slide having a transverse slit formed therein for displaceably supporting said set screw in said dovetail guide, and a nut disposed on said set screw for securing a position assumed by said slide.

10. Friction spinning apparatus according to claim 1, including a cleaning device for said wedge-shaped gap having a suction nozzle, and means for bringing said suction nozzle to said wedge-shaped gap, said suction nozzle being attached to said fiber guide channel at said ventilation opening at least during a cleaning process.

11. Friction spinning apparatus according to claim 1, including a cleaning device for said wedge-shaped gap having a suction nozzle, and means for bringing said suction nozzle to said wedge-shaped gap, said suction nozzle being introduced into said ventilation opening at least during a cleaning process.

12. In a friction spinning apparatus having two drums defining a wedge-shaped gap therebetween with a spinning region, and a fiber guide channel including one side having a slit-like fiber dispersion opening formed therein being disposed in the wedge-shaped gap and another side facing away from the fiber dispersion opening, the improvement comprising means disposed at the other side of the fiber guide channel for varying fiber mass distribution in the spinning region, said varying means including a variable ventilation opening formed in the fiber guide channel.

* * * * *